US006755323B2

(12) United States Patent
Haven et al.

(10) Patent No.: US 6,755,323 B2
(45) Date of Patent: Jun. 29, 2004

(54) APPARATUS FOR DISPENSING ARTICLES

(75) Inventors: Theodore C. Haven, Bath, PA (US); Larry Brown, West Chester, PA (US)

(73) Assignee: Accu-Sort Systems, Inc., Hatfield, PA (US)

( * ) Notice: Subject to any disclaimer, the term of this patent is extended or adjusted under 35 U.S.C. 154(b) by 226 days.

(21) Appl. No.: 09/991,745

(22) Filed: Nov. 21, 2001

(65) Prior Publication Data

US 2002/0084280 A1 Jul. 4, 2002

Related U.S. Application Data

(60) Provisional application No. 60/252,501, filed on Nov. 22, 2000.

(51) Int. Cl.[7] ..... A47B 57/58

(52) U.S. Cl. ..... 221/242; 221/241; 414/795.7; 211/208

(58) Field of Search ..... 221/242, 241; 271/171; 414/795.7; 211/59.2, 208

(56) References Cited

U.S. PATENT DOCUMENTS

| | | | | | |
|---|---|---|---|---|---|
| 945,126 | A | * | 1/1910 | Karr | 221/242 |
| 1,503,585 | A | * | 8/1924 | Headley et al. | 198/463.6 |
| 2,626,197 | A | | 1/1953 | Kollock | |
| 3,168,965 | A | | 2/1965 | Rinn | |
| 3,263,860 | A | | 8/1966 | Haas | |
| 3,282,466 | A | * | 11/1966 | Meresz et al. | 221/124 |
| 3,333,732 | A | * | 8/1967 | Schendorf et al. | 221/242 |
| 4,231,566 | A | * | 11/1980 | Suzuki | 271/117 |
| 4,697,803 | A | * | 10/1987 | Kan et al. | 271/127 |
| 4,779,745 | A | * | 10/1988 | Prendergast et al. | 211/59.2 |
| 4,986,615 | A | * | 1/1991 | Hieb et al. | 312/45 |
| 5,013,024 | A | * | 5/1991 | Stevens | 271/146 |
| 5,097,983 | A | * | 3/1992 | Ushiki et al. | 221/21 |
| 5,127,546 | A | * | 7/1992 | Chen | 221/242 |
| 5,335,822 | A | * | 8/1994 | Kasper | 221/259 |
| 5,586,685 | A | | 12/1996 | Dorner et al. | |
| 5,611,456 | A | * | 3/1997 | Kasper | 221/154 |
| 5,647,585 | A | * | 7/1997 | Cheong | 271/171 |
| 6,116,462 | A | * | 9/2000 | Takamura et al. | 221/241 |
| 6,302,293 | B1 | * | 10/2001 | Wittern et al. | 221/92 |
| 2003/0085510 | A1 | * | 5/2003 | Abe et al. | 271/171 |

FOREIGN PATENT DOCUMENTS

| | | | | |
|---|---|---|---|---|
| JP | 2-300890 | * | 12/1990 | 221/242 |
| JP | 3-291797 | * | 12/1991 | 221/242 |
| JP | 4-162194 | * | 6/1992 | 221/242 |

* cited by examiner

*Primary Examiner*—Donald P. Walsh
*Assistant Examiner*—Daniel K Schlak
(74) *Attorney, Agent, or Firm*—Volpe and Koenig, P.C.

(57) ABSTRACT

An adjustable frame for dispensing stackable items. The adjustable frame includes a first panel having a first edge, a first-panel-dispensing-end, and a first major surface. The major surface is configured to guide stacked items prior to dispensing. A second panel has a second edge, a second-panel-dispensing-end, and a second major surface. The second major surface is configured to, in combination with the first major surface, guide stacked items prior to dispensing. An adjustable panel has a third edge and a third major surface. The third edge is detachably securable in one of a plurality of locations on the second major surface of the second panel. The adjustable panel can be positioned proximate to any one of the plurality of locations to accommodate items of various sizes.

28 Claims, 10 Drawing Sheets

FIG. 8
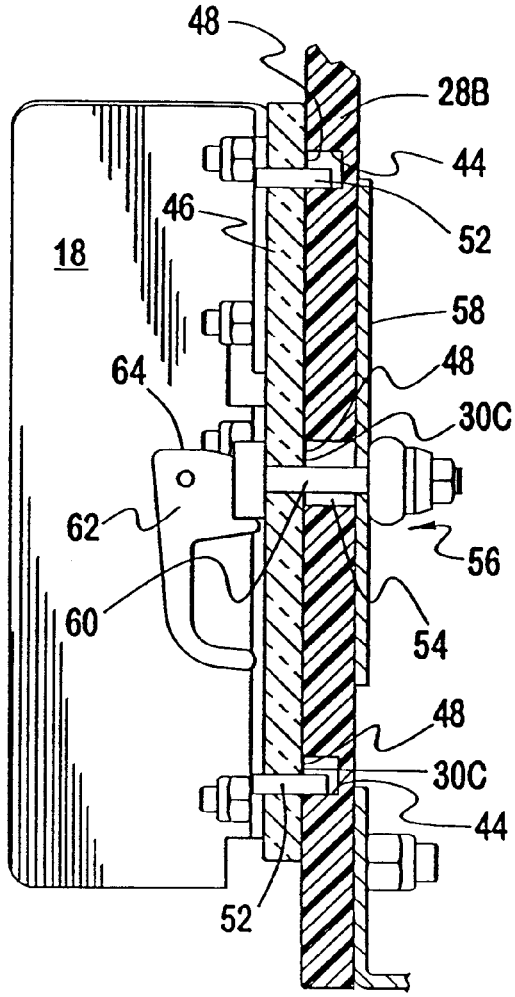
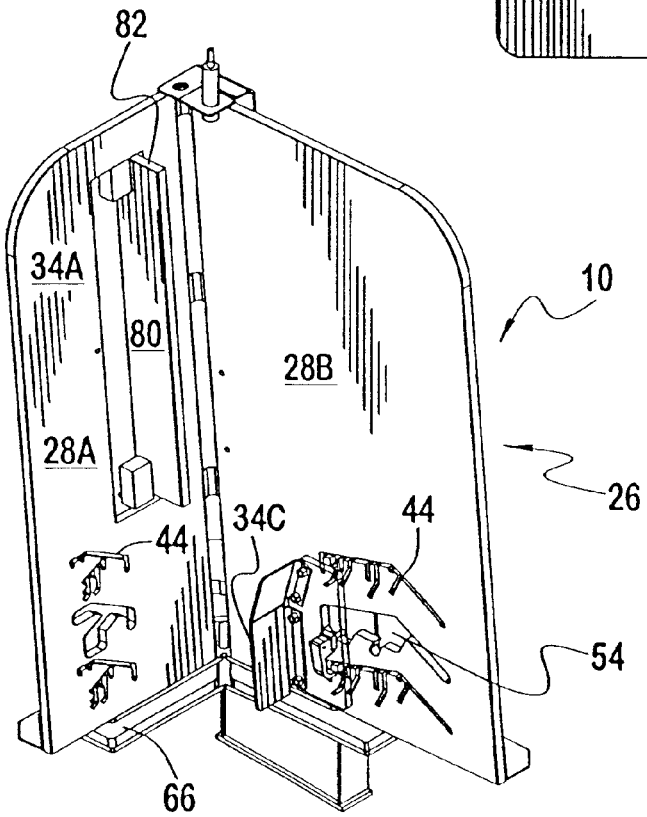
FIG. 9

APPARATUS FOR DISPENSING ARTICLES

CROSS REFERENCE TO RELATED APPLICATION

This application claims the benefit of U.S. provisional patent application No. 60/252,501, filed Nov. 22, 2000, entitled "Article Dispenser."

BACKGROUND

The present invention relates generally to article dispensers and, more specifically, to an apparatus for dispensing stackable articles of various sizes. Some commonly dispensed articles are video tapes, cardboard cartons containing pharmaceuticals, compact disks, dental film packs, candies, cigarettes or the like.

In operation, dispensers are typically placed above a conveyor to allow articles to be dispensed thereon to be further processed. One drawback of conventional dispensers that utilize article receptacles having walls on at least three article sides is the inability to easily adjust the dispensers to hold articles of varying sizes.

What is needed, but has not yet been provided by the prior art, is an article dispenser that is easily adjusted to accommodate articles of varying size and that can incorporate a coding system to allow for improved and simplified adjustment of the dispenser to hold articles of varying sizes.

SUMMARY OF THE INVENTION

Briefly speaking, one embodiment of the present invention is directed to an apparatus for dispensing stackable articles onto a surface. The apparatus includes first and second generally planar panels connected to form two sides of an article receptacle having a bottom edge. The first panel is angled from a perpendicular relative to the surface. At least one of the first and second panels has a groove pattern defined therein. An adjustable panel slidably engages the groove pattern to allow selective positioning of the adjustable panel to define a third side of the article receptacle. The adjustable panel is slidably moveable between a plurality of locations allowing the article receptacle to hold articles of various sizes depending on the positioning of the adjustable panel.

BRIEF DESCRIPTION OF THE DRAWINGS

The foregoing summary, as well as the following detailed description of the preferred embodiment of the present invention, will be better understood when read in conjunction with the appended drawings. For the purpose of illustrating the invention, there is shown in the drawings an embodiment which is presently preferred. It is understood, however, that the invention is not limited to the precise arrangement and instrumentality shown. In the drawings:

FIG. 8 is a partial cross-sectional view along the line 8—8 of FIG. 3;

FIG. 9 is a perspective view of the dispenser of FIG. 1 illustrating a sub panel disposed in a second position to form part of an article receptacle;

DETAILED DESCRIPTION OF THE PREFERRED EMBODIMENTS

Figure 1:
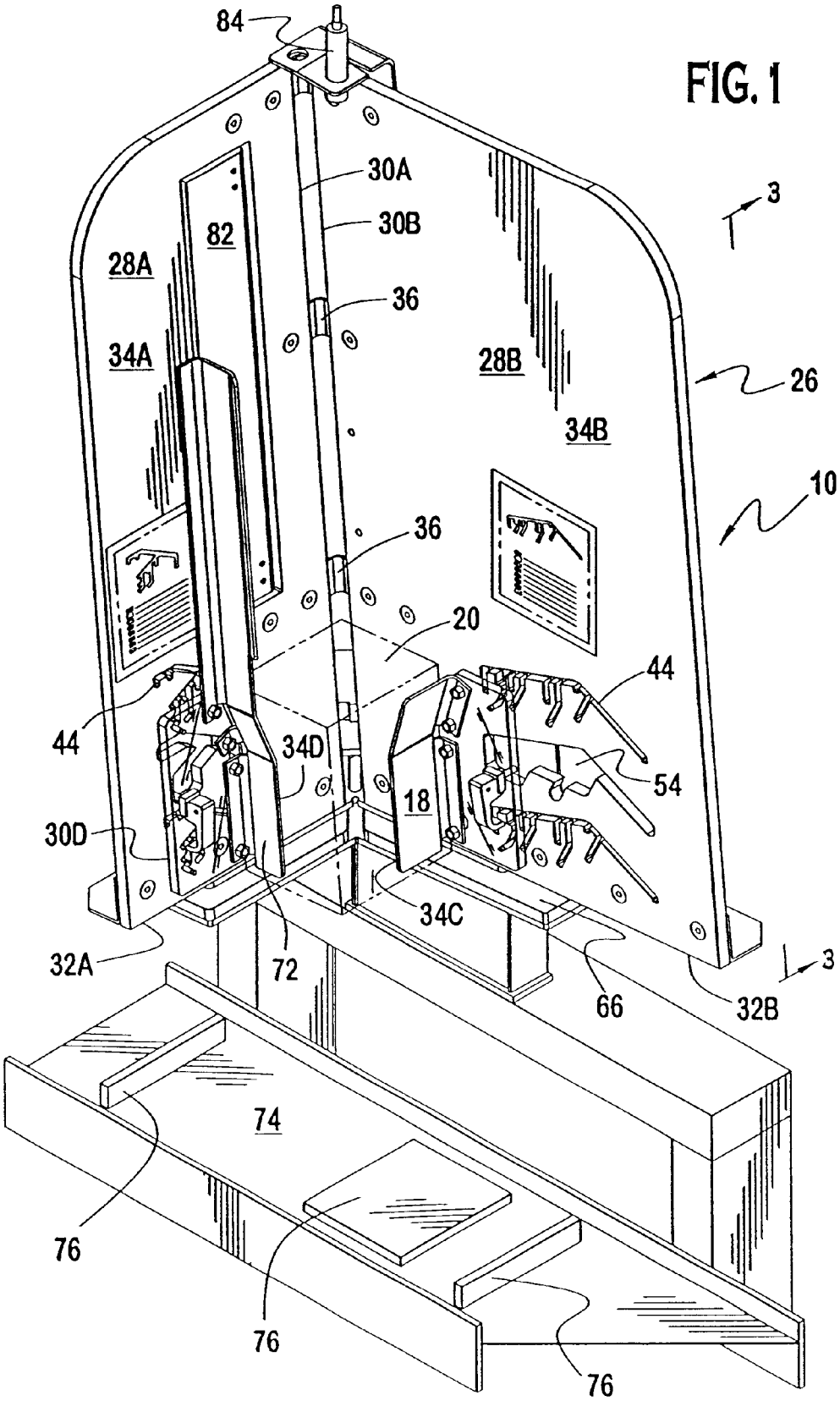
FIG. 1 is perspective view of a dispenser according to the preferred embodiment of the present invention.

The terms "right," "left," "lower," "upper," "inwardly" and "outwardly" are used for convenience only to designate directions in the referenced drawings.

Referring to the drawings in detail, wherein like numerals indicate like elements throughout, there is shown in FIGS. 1–12 a preferred embodiment of a dispensing apparatus, generally designated 10. The dispensing apparatus 10 preferably uses at least one adjustable panel 18 (further described below) that can be slidably moved along one of a first and second panel 28A, 28B (further described below) between a plurality of locations. The adjustable panel 18 allows the dispensing apparatus 10 to be quickly adjusted to hold a stack of articles 20 that have a different size from that for which the dispenser 10 was previously configured to hold.

Unless otherwise stated, it is preferred that the dispensing apparatus 10 is formed of a rigid, durable, light weight material, such as high impact plastic. However, those of ordinary skill in the art will appreciate from this disclosure that various materials, such as stainless steel, aluminum, galvanized steel, alloys, suitable polymeric materials or the like, can be used without departing from the scope of the present invention.

The dispensing apparatus 10 of the present invention preferably, but not necessarily, includes several aspects (that can be integrated as desired into a single dispenser 10), such as an adjustable frame, a plurality of markings 70 used to code various positions on the adjustable frame 26, the use of a sub panel 80, and the orientation of the adjustable frame 26 relative to a surface 74 that receives dispensed items 76. Initially, only the construction of the adjustable frame 26, and related components, will be discussed.

Figure 7:
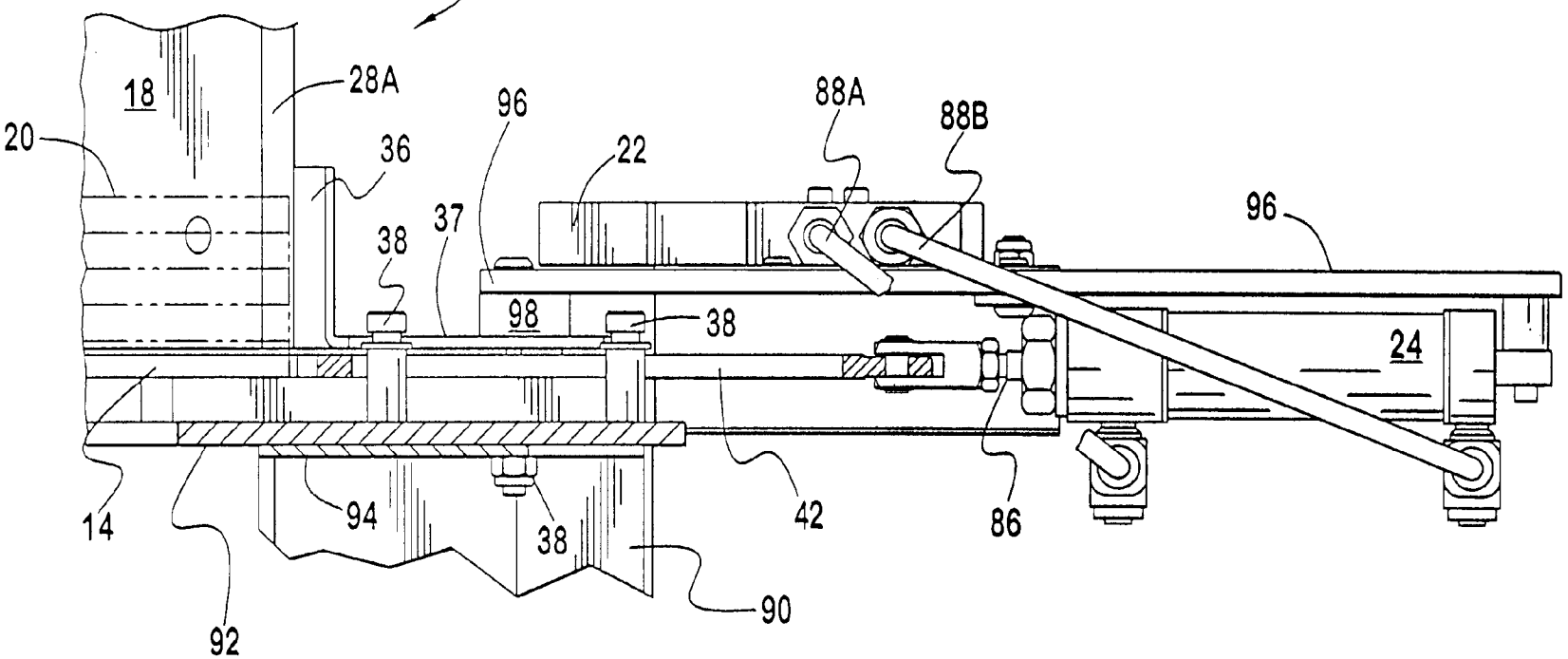
FIG. 7 is a partial cross-sectional view along the line 7—7 of FIG. 5.

Referring to FIG. 7, it is preferable that the functions of the dispensing apparatus 10 are controlled by a controller 22. The controller 22 may be located on the dispensing apparatus 10 (as described below) or remotely located. In the preferred embodiment, the controller 22 operates a pump (not shown) to regulate the amount of fluid in a cylinder 24 (further described below). Those of ordinary skill in the art will appreciate from this disclosure that the cylinder 24 can be replaced with an electric motor (not shown) or the like without departing from the scope of the present invention.

As best shown in FIGS. 1 and 9, the dispensing apparatus 10 includes an adjustable frame, or third panel, 18 for dispensing stackable articles, or items, 20. Referring to FIGS. 1, 3, 5 and 7, stacked articles 20 are shown with phantom lines (depending on the figure, the phantom lines outline the entire stack or outline each of the stacked items 20). The stacked articles 20 may include compact disks, video cassettes, packages of medicine or the like.

As best shown in FIG. 1, the adjustable frame 26 includes a first panel 28A having a first edge 30A, a first-panel-dispensing-end 32A and a first major surface 34A. The first panel 28A preferably has a generally rectangular shape with one rounded corner. The first major surface 34A is configured to guide stacked items 20 prior to dispensing from a location proximate to the first-panel-dispensing-end 32A.

Figure 2:
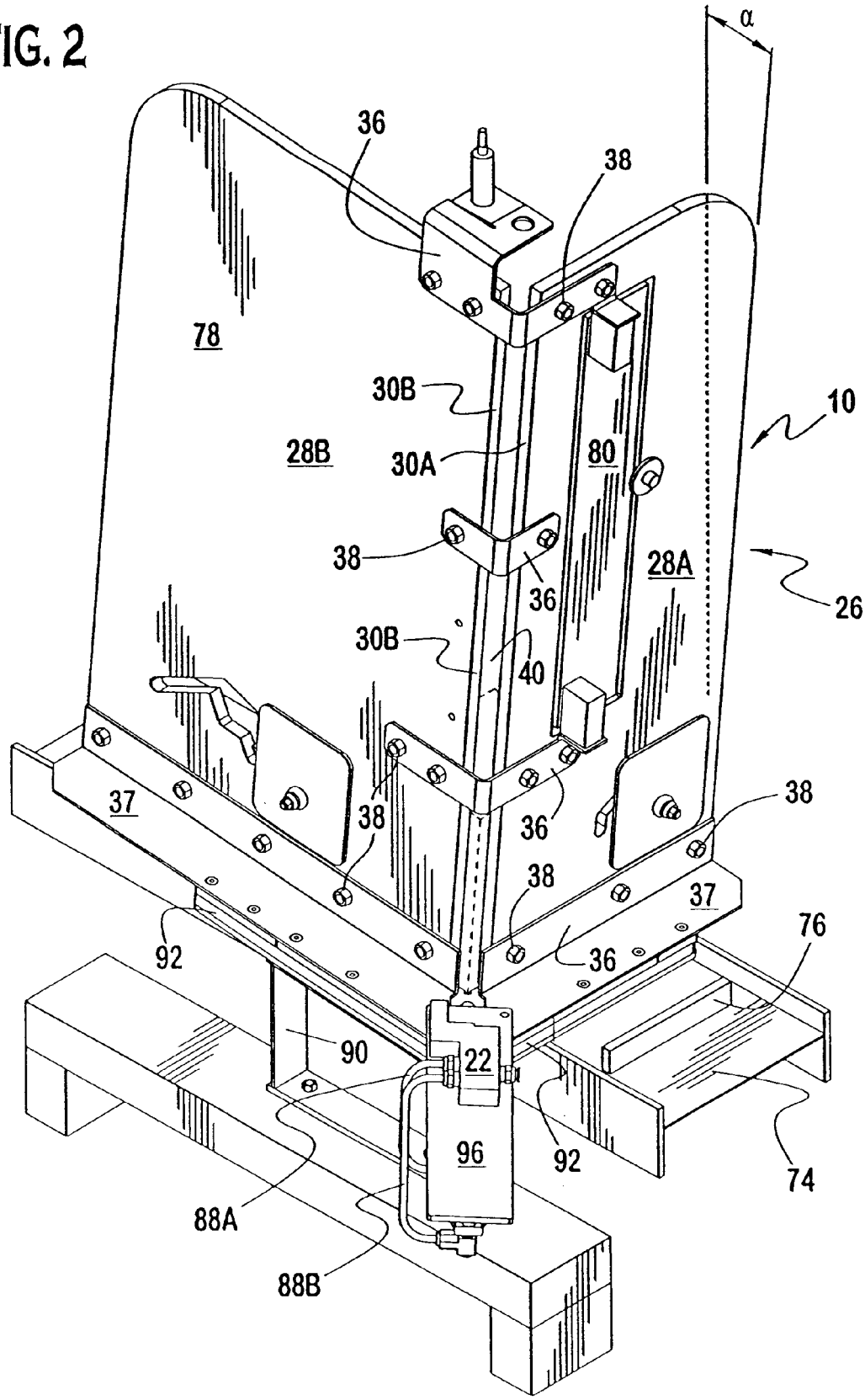
FIG. 2 is another perspective view of the dispenser of FIG. 1.

A second panel 28B has a second edge 30B, a second-panel-dispensing-end 32B, and a second major surface 34B. It is preferable, but not necessary, that the first and second panels 28A, 28B are at a right angle with respect to each other. The second edge 30B is preferably located proximate to the first edge 30A of the first panel 28A. As best shown in FIG. 2, the first and second edges 30A, 30B of the first and second panels 28A, 28B can be disposed in a spaced apart generally parallel fashion with the first and second panels 28A, 28B fastened together with brackets 36 and fasteners 38.

Referring to FIGS. 2 and 7, the first and second panels 28A, 28B are attached to each other via a plurality of generally L-shaped brackets 36. Those of ordinary skill in the art will appreciate that the first and second panels 28A, 28B can be joined directly using fasteners, adhesive, welding or formed as one piece without departing from the scope of the present invention. The first and second panels 28A, 28B (in combination with the remaining portions of the dispenser) are supported by a stand 90.

The stand 90 preferably has a stand top 94 which is fastened to supporting girders 92. The girders 92, in combination with brackets 36, connect the first and second panels 28A, 28B (as well as the remaining portions of the dispenser 10) to the stand 90. The brackets 36 are preferably L-shaped with one leg fastened to one of the first and second panels 28A, 28B using fasteners 38. The second leg of the brackets 36 forms a bracket flange 37 that is fastened to at least one of the girders 92. Additionally, an accessory plate 96 is attached to the support girders 92 via a connecting block 98 that facilities a fixed connection between the accessory plate 96 and the stand top 94. The accessory plate 96 preferably supports the controller 22 and the cylinder 24.

Figure 5:
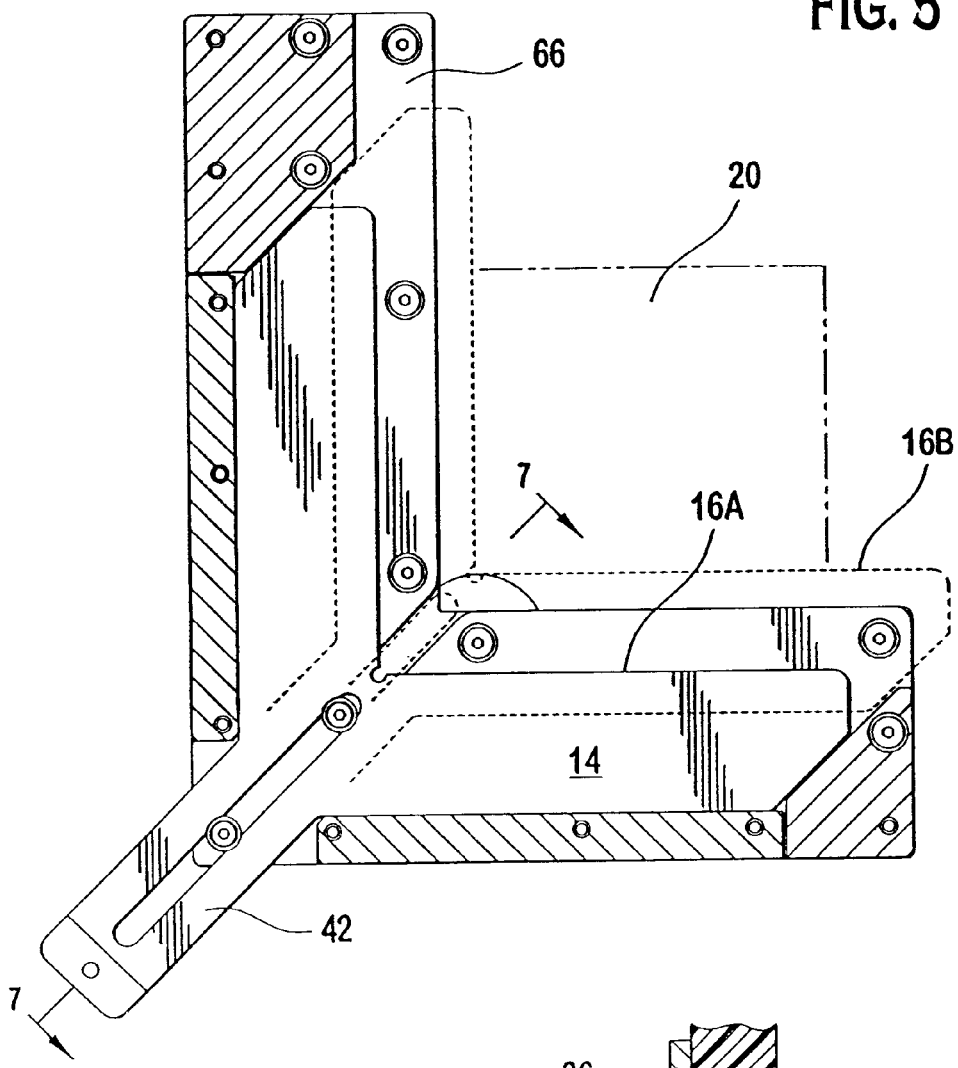
FIG. 5 is a cross-section along the line 5—5 of FIG. 3.

Referring to FIGS. 2 and 5, it is preferable that a space 40 is maintained between the first and second panels 28A, 28B to allow a shaft 42 of a pushing member 14 to easily move in a reciprocating fashion between the first and second panels 28A, 28B. The second major surface 34B is configured to, in combination with the first major surface 34A, guide stacked items 20 prior to dispensing from a location proximate to the second-panel-dispensing-end 32B. The panel dispensing ends 32A, 32B of the first and second panels 28A, 28B preferably define a bottom plane of the article receptacle. The first and second panel dispensing ends 32A, 32B preferably lie in the bottom plane such that the first and second panels 28A, 28B are preferably, but not necessarily, perpendicular to the bottom plane of the article receptacle.

Figure 3:
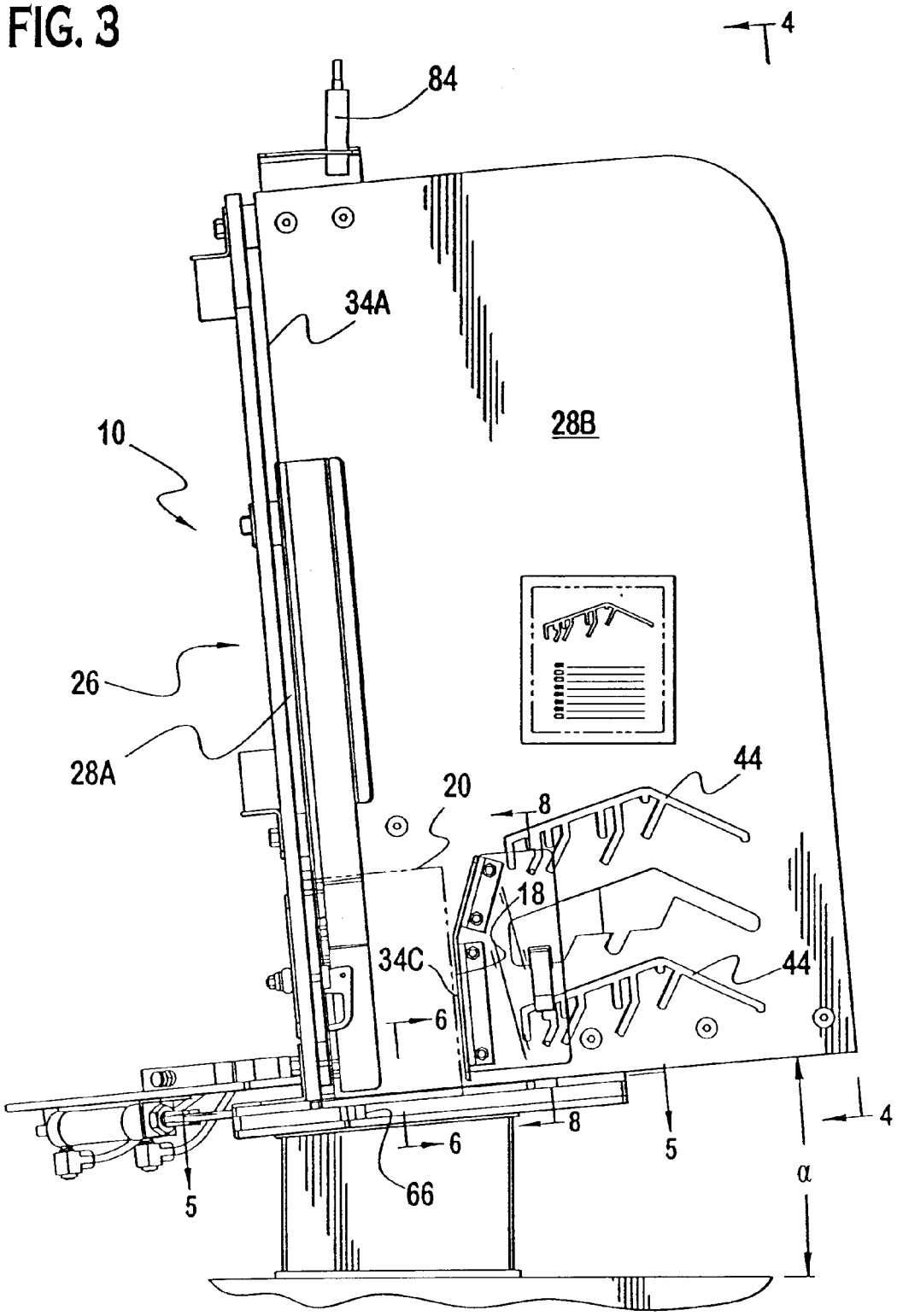
FIG. 3 is a view of the dispenser of FIG. 1 as viewed in the direction of line 3—3 of FIG. 1.
Figure 4:
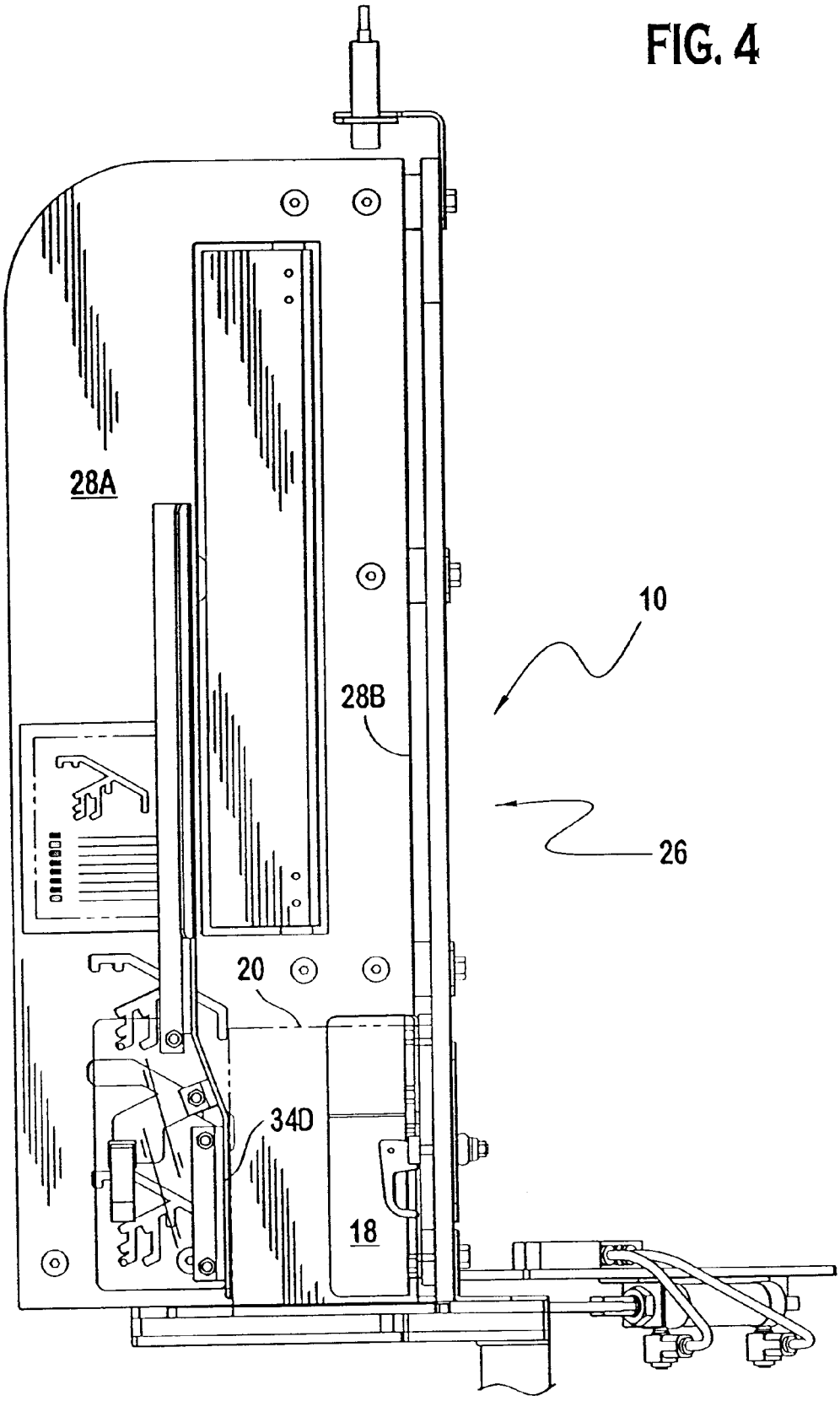
FIG. 4 is a view of the dispenser of FIG. 3 as viewed in the direction of line 4—4 of FIG. 3.

Referring to FIGS. 1, 3 and 9, it is preferable that the second panel 28B includes a groove pattern 44 disposed in the second major surface 34B. Those of ordinary skill in the art will appreciate from this disclosure that the groove pattern 44 can be disposed on the first panel 28A or in both the first and second panels 28A, 28B without departing from the scope of the present invention.

As best shown in FIGS. 1, 8 and 9, an adjustable panel 18 has a third edge 30C and a third major surface 34C. The third edge 30C is detachably securable in one of a plurality of locations (further described below) on the second major surface 34B of the second panel 28B. As best shown in FIGS. 3 and 8, the groove pattern 44 allows the adjustable panel 18 to be slidably moved from one of the plurality of locations to another of the plurality of locations. While it is preferred that the adjustable panel 18 is attached to two separate groove patterns 44, those of ordinary skill in the art will appreciate from this disclosure that a single groove pattern 44 can be used to support the adjustable panel 18 without departing from the scope of the present invention.

As best shown in FIG. 8, the adjustable panel 18 preferably includes a flange 46 disposed proximate to and angled relative to the third major surface 34C. The adjustable panel flange 46 provides a major flange surface 48 that forms the third edge 30C of the adjustable panel 18. The major flange surface 46 is preferably in sliding contact with the second major surface 34B of the second panel 28B.

Figure 10:
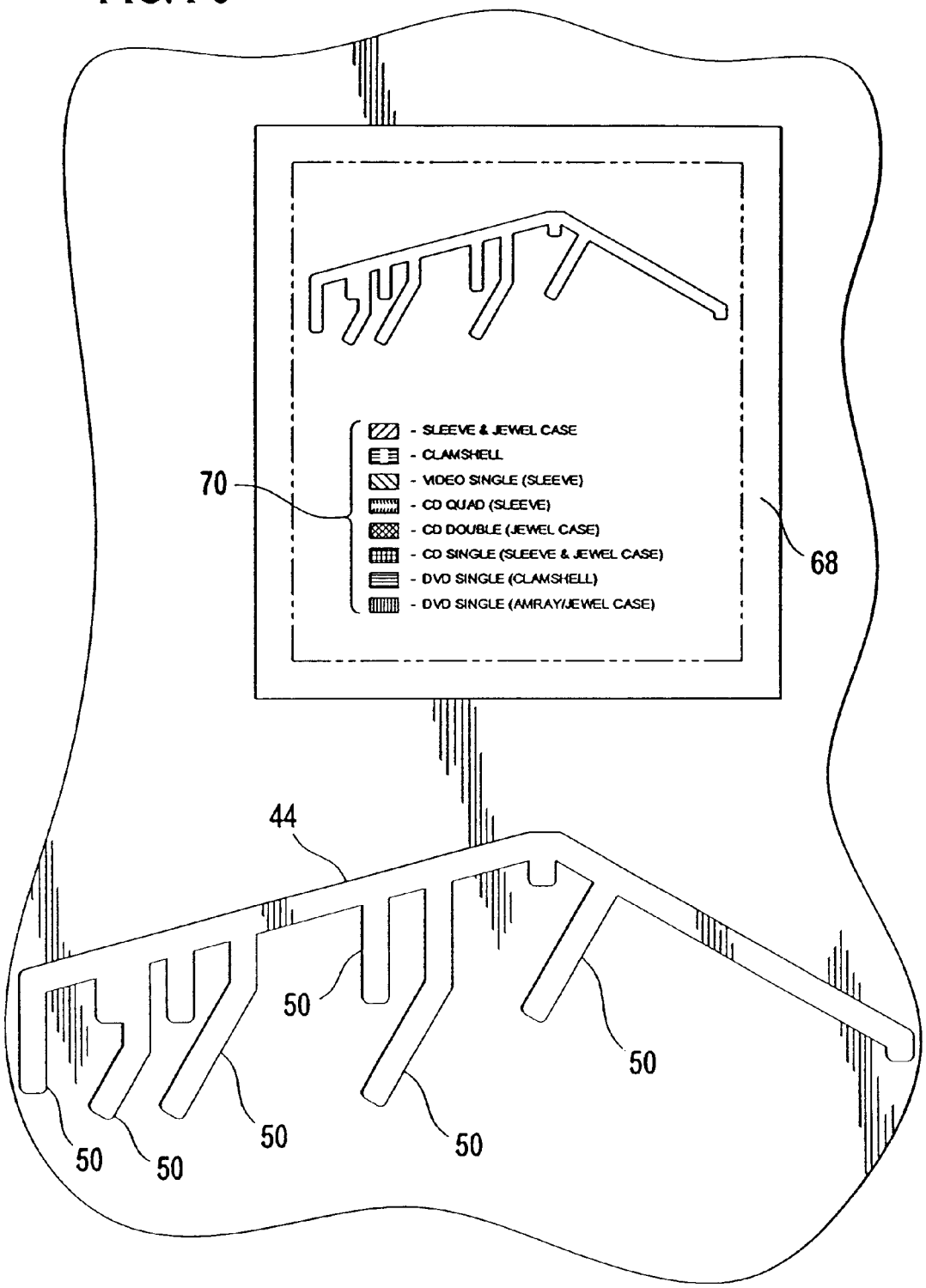
FIG. 10 is an enlarged partial elevational view of one of a first and second panel of the dispenser of FIG. 1 illustrating a groove pattern and an illustration of the groove pattern.
Figure 11:
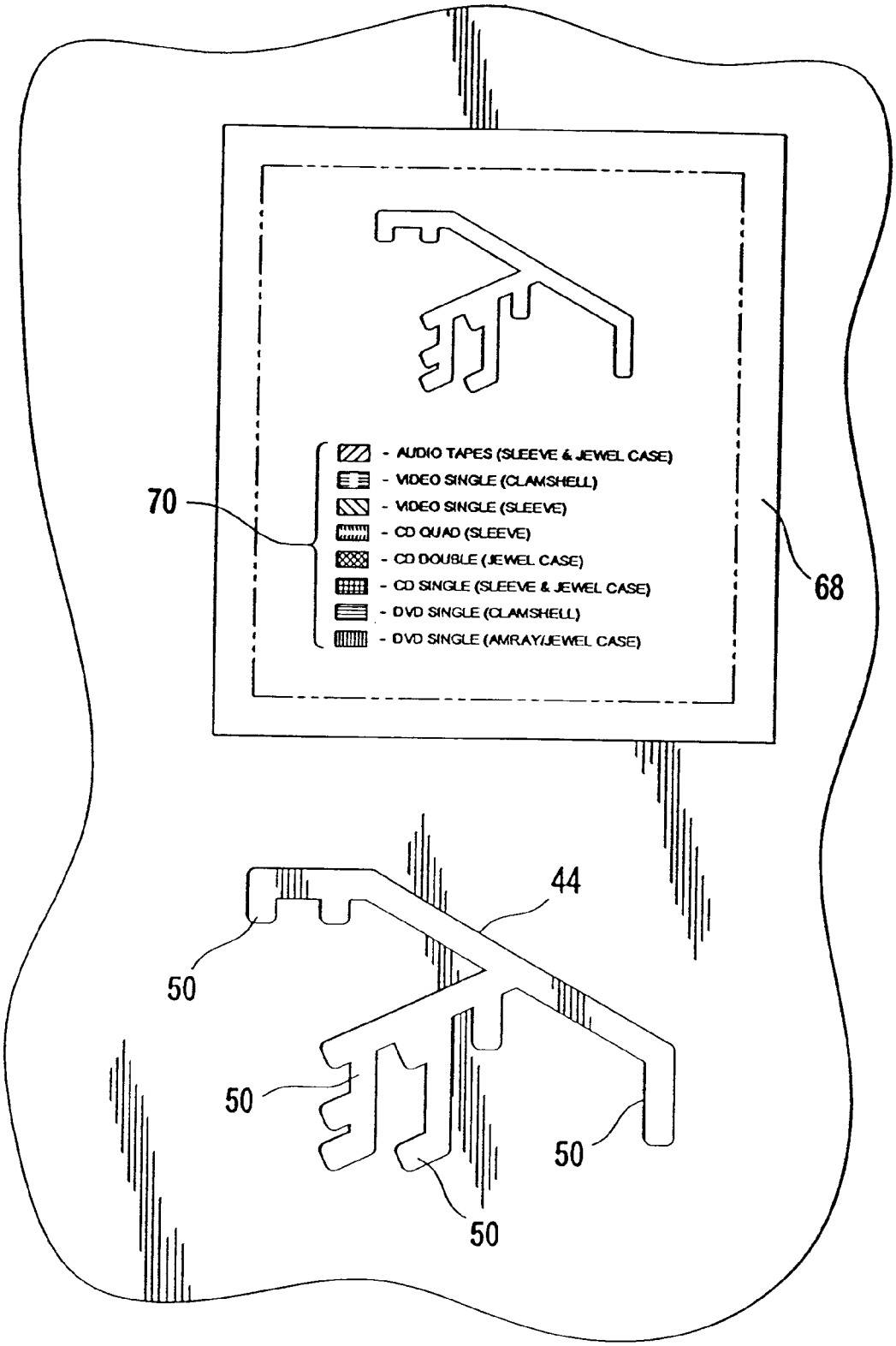
FIG. 11 is an enlarged partial elevational view of one of the first and second panels of the dispenser of FIG. 1 illustrating a second preferred groove pattern and an illustration of the second preferred groove pattern.
Figure 12:
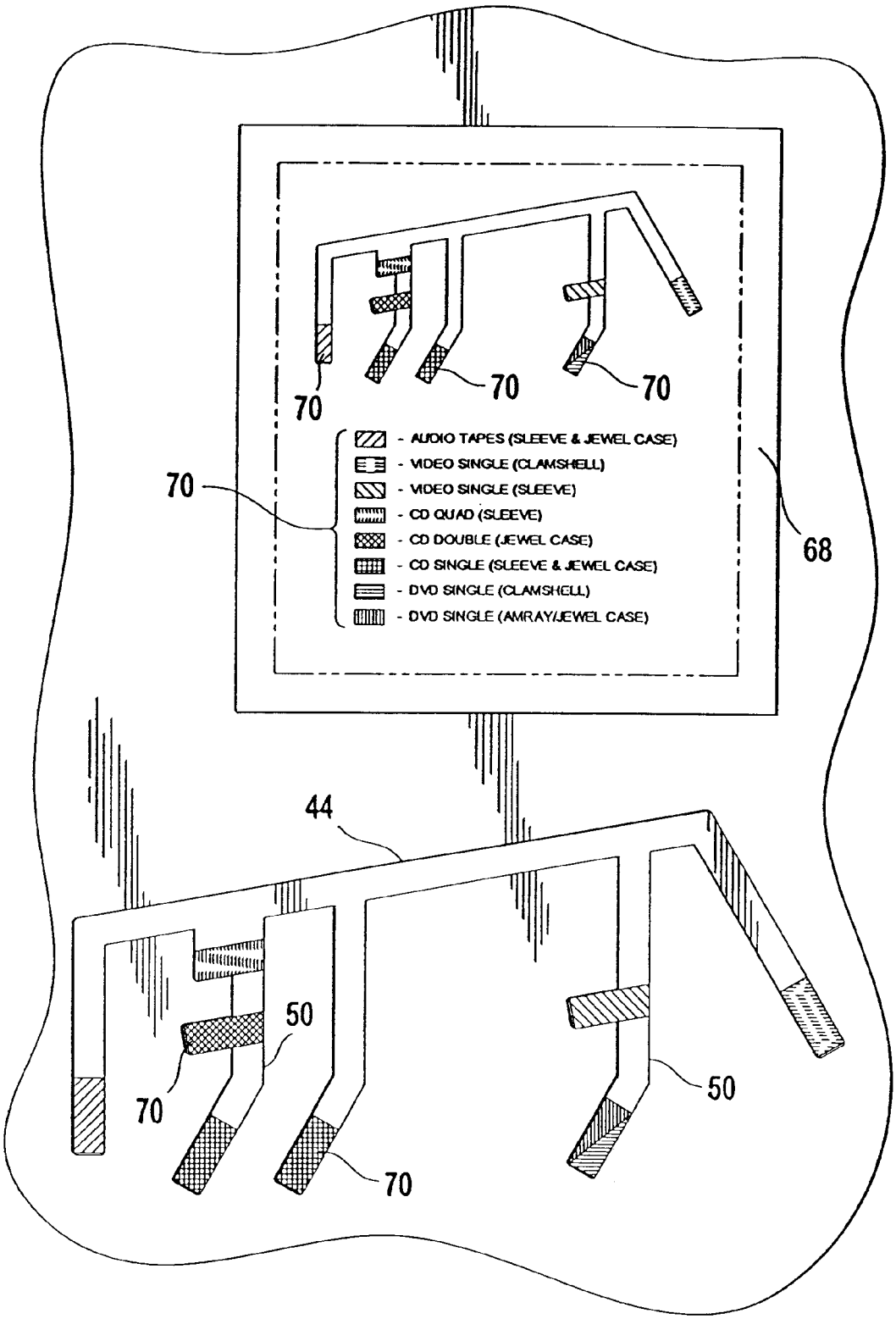
FIG. 12 is an enlarged partial view of one of the first and second panels of the dispenser of FIG. 1 illustrating a groove pattern having a plurality of distinct markings and an illustration of the groove pattern that identifies each of the plurality of downwardly extending channels using one of the plurality of distinct markings.

As best shown in FIGS. 10–12, each groove pattern 44 preferably includes a plurality of downwardly extending channels 50 that allow the adjustable panel 18 to be slid into one of the plurality of locations to create a gravity bias against the adjustable panel 18 being moved from the one of the plurality of locations. Referring again to FIG. 8, it is preferable that at least one peg 52 extends from the major flange surface 48 to engage the groove pattern 44 in the second major surface 34B of the second panel 24B. It is also preferable, but not necessary, that the groove pattern 44 not extend completely through the first or second panel 28A or 28B.

Referring to FIGS. 1 and 8, in addition to the sliding engagement between the panel groove pattern 44 and the adjustable panel peg 52, the combination of a panel cutout 54 and an adjustable panel supported compression mechanism 56 is used to detachably secure the adjustable panel 18 in position. Referring to FIGS. 8 and 9, the second panel 28B preferably includes a cutout 54 which extends therethrough. A support plate 58 is preferably slidingly disposed on a side of the second panel 28B, opposite the second major surface 34B, and is coupled to the adjustable panel 18 via a connector 60. It is preferable that the connector 60 is attached on one end to the support plate 58, is attached on another end to the adjustable panel 18, and extends through the cutout 54 in the second panel 28B. The connector 60 is capable of urging the adjustable panel 18 toward the support plate 58 to secure the adjustable panel 18 against the second panel 28B. A handle 62 is attached to the connector 60 and is configured so that when the handle is rotated counter clockwise a handle cam surface 64 causes the support plate 58 to move toward the adjustable panel 18 to secure the adjustable panel 18 in position by squeezing the second panel 28B between the adjustable panel 18 and the support plate 52.

Referring to FIGS. 1, 3 and 9, once the adjustable panel 18 is in position, the third major surface 34C generally opposes the first major surface 34A of the first panel 28A and is configured to prevent items 20 from falling generally away from the first panel 28A prior to being dispensed. Thus, by properly positioning the peg(s) 52 of the adjustable panel 18 in the proper pattern groove channel 50, the adjustable panel 18 is properly positioned so that the distance between the third major surface 34C and the first major surface 34A corresponds to the size of the stacked items 20 held by the dispensing apparatus 10. The adjustable panel 18 can be positioned proximate to any one of the plurality of locations to accommodate items of various sizes.

The ability to quickly move adjustable panel 18 from one position to another along a corresponding panel 28A or 28B by rotating the handle 62 clockwise (as viewed in FIG. 8) to allow the adjustable panel 18 to be slid through its corresponding groove pattern(s) 44 provides for quick and easy adjustment of the dispensing apparatus 10 to hold items of various sizes. Further improving dispenser efficiency, the dispensing apparatus 10 does not require tools or the disassembly of component parts to move the adjustable panel 18 from one location to another along one of the first and second panels 28A, 28B.

An article receptacle is preferably defined by the first and second, generally planar, panels 28A, 28B in combination with the adjustable panel 18 (that is preferably slidably engaged with at least one groove pattern 44 to allow selective positioning of the adjustable panel 18) that defines a third side of the article receptacle. Items 20 stacked within the article receptacle are preferably supported by a base plate 66. The base plate 66 is disposed proximate to the first-panel-dispensing-end 32A and the second-panel-dispensing-end 32B of the first and second panels 28A, 28B and is preferably generally L-shaped. The base plate 66 is positioned adjacent to a bottom edge of the article receptacle and is adapted to retain an article 20 in the article receptacle. The base plate 66 is preferably configured to support one end of a stack of items 20 by supporting two edges of the article 20 located at the bottom of the stack.

Referring again to FIGS. 10–12, the dispensing apparatus 10 preferably includes an illustration 68 of the groove pattern 44. The illustration 68 is preferably positioned on one of the first and second panels 28A, 28B to further increase the efficiency with which the dispensing apparatus 10 can be adjusted.

The illustration 68 allows an operator to quickly determine the appropriate location for the adjustable panel 18 depending on the particular type of items 20 to be dispensed. The illustration 68 preferably identifies each of the plurality of locations with a different one of a plurality of distinct markings 70, such as colors, numerals, brail, pictures, symbols or the like. A different one of the plurality of distinct markings 70 preferably labels an illustration of each of the plurality of downwardly extending channels 50. The distinct markings 70 each represent a corresponding one of differently sized stackable items. It is preferred that when the adjustable panel 18 is fully engaged with one of the downwardly extending channels 50, that the panel 18 is properly positioned for the adjustable frame 26 to hold a stack of items 20 of the type represented by the corresponding distinct marking 70.

The adjustable frame 26 preferably has a different distinct marking 70 disposed on the second major surface 34B (or on the first major surface 34A when the groove pattern 44 is in the first panel 28A) proximate to each of the downwardly extending channels 50. Each of the distinct markings 70 represents one of differently sized stackable items 20. This allows a low skilled operator to determine how to position the adjustable panel 18 by examining the illustration 68 to determine the appropriate distinct marking 70 for the stacked item.

Instead of identifying the type of dispensable item represented by a distinct marking 70 in words, each distinct marking 70 can be illustrated next to a picture of the appropriate item 20. Once the appropriate distinct marking 70 has been identified by the operator, the adjustable panel 18 is moved so that the pegs 52 of the adjustable panel 18 are positioned in the downwardly extending channel 50 that is also labeled with the desired distinct marking 70. Thus, when the adjustable panel 18 is fully engaged with one of the downwardly extending channels 50, the adjustable panel 18 is properly positioned for the adjustable frame 26 to hold stacked items 20 having a size corresponding to the stackable item 20 represented by the distinct marking 70 disposed proximate to the downwardly extending channel 50 securing the adjustable panel 18.

As best shown in FIG. 1, it is preferable, but not necessary, that the adjustable frame 26 include a second adjustable panel, or fourth panel, 72 that is slidably engaged with a groove pattern 44 to allow selective positioning of the second adjustable panel 72 to define a fourth side of the article receptacle. The second adjustable panel 72 has a fourth edge 30D and a fourth major surface 34D. The fourth edge 30D is detachably securable in one of a second plurality of locations on the first major surface 34A of the first panel 28A (or in one of the plurality of locations on the second major surface 34B of the second panel 28B when the second adjustable panel 72 is disposed on the second panel 28B). The fourth major surface 34D generally opposes the second major surface 34B of the second panel 28B and is configured to prevent items 20 from falling generally away from the second panel 28B prior to being dispensed. The second adjustable panel 72 can be positioned proximate to any one of the second plurality of locations to accommodate items of various sizes.

Referring to FIGS. 1 and 2, the adjustable frame 26 is preferably, but not necessarily, part of a system for dispensing stackable items onto a surface 74 for receiving at least one dispensed item 76. The surface 74 is preferably part of a conveyor. It is preferable, but not necessary, that the dispenser 10 is disposed above the surface 74 in a tilted configuration such that the second panel 28B (or the first panel 28A depending upon the direction of tilt of the adjustable frame 26) defines a plane 78 generally perpendicular to the surface 74 and the first panel 28A (or the second panel 28B depending upon the direction of tilt of the adjustable frame 26) defines another plane forming less than a ninety (90) degree angle with the surface 74. Stacked items 20 are prevented from falling from the dispenser apparatus 10 prior to dispensing by a combination of the first channel 28A (or the incline of the second panel 28B depending upon the tilt of the adjustable frame 26) and the adjustable panel 18. If desired, both the first and second panels 28A, 28B can be angled from a perpendicular relative to the surface 74 without departing from the present invention.

Referring to FIGS. 2 and 9, it is preferable, but not necessary, that the first dispenser panel 28A includes a sub panel 80 having a sub-panel-major-surface 82. The sub panel 80 is rotatable between a first position (shown in FIG. 2), in which the sub-panel-major-surface 82 forms a portion of the first major surface 34A, and a second position (shown in FIG. 9), in which the sub-panel-major-surface 82 opposes the second major surface 34B of the second panel 28B. When the sub panel 80 is in the second position (shown in FIG. 9), the sub panel 80 is adapted to prevent stacked items 20 from falling away from the second panel 28D prior to being dispensed.

As best shown in FIGS. 1–3, the dispensing apparatus 10 preferably includes an optical detector 84 that is positioned proximate to the top of the dispensing apparatus to detect when the dispensing apparatus 10 is empty. Other known methods of detecting stacked items 20 can also be used.

Figure 6:
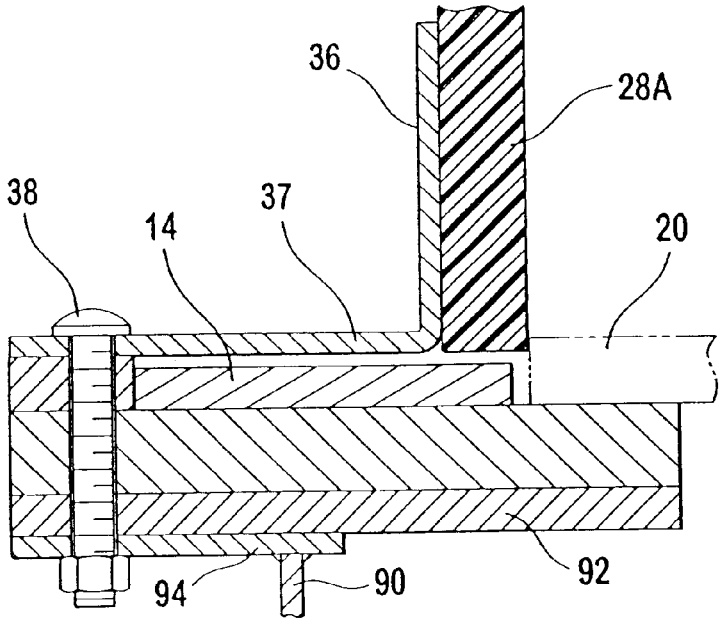
FIG. 6 is a cross-section along the line 6—6 of FIG. 3.

Referring to FIGS. 5–7, the pushing member 14 is preferably moved between a first position (shown in solid lines) 16A and the second position (shown in dashed lines) 16B in which at least one stackable item 20 is ejected from the dispensing apparatus 10. It is preferred that at least one adjustable panel 18 forms a stripping member to prevent an entire stack of items 20 from being pushed off of the base plate 66 and ejected from the dispenser apparatus 10. However, those of ordinary skill in the art will appreciate from this disclosure that a stripper can be used in conjunction with a single adjustable panel 18 to prevent the dispensing of stacked articles 20 in an amount greater than a predetermined number. An article dispenser having a suitable stripping apparatus is disclosed in detail in U.S. Pat. No. 5,586,685 which is hereby incorporated by reference herein in its entirety as if fully set forth.

The pushing member 14 is reciprocally driven by a piston 24 which is connected to the pushing shaft 42 via a rod 86. First and second fluid conduits 88A,88B regulate the flow of fluid from a reservoir (not shown) to the piston 24. To extend the pushing member 14 to dispense the lower article 20 from a stack of articles 20, the controller 22 activates the pump causing fluid to be transported from the reservoir, through the second fluid conduit 88B, and into the piston 24 causing the rod 86 to be outwardly driven. As the rod 86 extends outwardly, the pushing member 14 moves toward the second position 16B causing the bottom article(s) to be slid off of the base plate 66 and dispensed from the apparatus 10. Then, the controller 22 allows fluid to be removed from the piston via the first conduit 88A allowing the rod 86 to retract (assuming that the rod 86 is biased into the retracted position). The rod 86 is preferably biased, via a spring or the like, in the retracted position. Thus, when the piston fluid pressure is reduced, the rod 86 automatically retracts.

The preferred construction of the adjustable frame 26 (and related components) has been described above. What follows will be a description of the preferred positioning of the adjustable frame 26 relative to a surface 74 for receiving dispensed items 76, and the operation of the apparatus 10 during, the dispensing of individual, or multiple, stacked items 20.

Referring to FIGS. 1 and 2, the dispensing apparatus 10 is preferably supported above the conveyor 74 via the rigid stand 90. However, those of ordinary skill in the art will appreciate from this disclosure that the dispensing apparatus 10 can be supported above the conveyor 74 via a motorized adjustable stand (not shown) or the like without departing from the scope of the present invention.

Referring to FIGS. 1–12, one embodiment of the dispensing apparatus 10 of the present invention preferably operates as follows. An operator examines the illustration 68 showing which downwardly extending channel 50 is appropriate for the articles that will be dispensed. The operator identifies the correct distinct marking 70 and examines the illustration to determine which downwardly extending channel 50 is labeled by the distinct marking 70. Then, the operator rotates the handle 62 of the adjustable panel in the clockwise direction causing the support plate 58 to move generally outwardly and to allow the adjustable panel 18 to be slidably moved within the groove pattern(s) 44. Then, the operator slides the adjustable panel 18 through the groove pattern 44 until the pegs 52 of the adjustable panel 18 are appropriately positioned in the downwardly extending channel 50 corresponding to the distinct marking 70 for the type of article 20 that will be dispensed. Once the adjustable panel 18 is properly positioned in the groove pattern(s) 44, the adjustable panel 18 is preferably gravity biased into position due to the downward slope of the channels 50. The operator then rotates the adjustable panel handle 62 counterclockwise causing the cam surface 64 of the handle 62 to press against the respective panel 28A or 28B and drive the support plate 58 generally inwardly. The rotation of the handle 62 counterclockwise causes the first or second panel 28A or 28B to be compressed between the adjustable panel flange 46 and the support plate 58. The operator can optionally repeat the above procedure to properly position a second adjustable panel 72 to form a fourth side of the article receptacle. Articles 20 are then stacked on the base plate 66 and are ready for dispensing, preferably in a sequential manner. The controller 22 activates a pump which drives fluid from a reservoir, through the second fluid conduit 88B, and into the piston 24 causing the rod 86 to extend outwardly. As the rod 86 extends outwardly, the linked pushing member 14 moves into the second position 16B causing the lower article(s) to be dispensed from the apparatus 10. Then, the controller 22 causes fluid to be removed from the piston 24 via the first fluid conduit 88A and the rod 86 moves into its biased, equilibrium, retracted position. As the rod 86 moves into its retracted position, the pushing member 14 moves into the first position 16A which allows the remaining stacked articles 20 to slide downwardly and be braced upon the base plate 66. The reciprocation of the pushing number 14 is continued as desired until all of the articles are dispensed. Once the article dispenser 10 is empty, the optical detector 84 signals the controller 22 which stops the reciprocation of the pushing number 14.

Once all of the articles are dispensed, the apparatus 10 can be reloaded or easily adjusted to hold articles of a different size by following the above procedure. The dispensing apparatus of the present invention can be quickly adjusted to hold articles of various sizes and can be operated by low skilled workers via the use of the coded groove patterns 44.

It is recognized by those skilled in the art, that changes may be made to the above-described embodiment of this invention without departing from the broad inventive concept thereof. It is understood, therefore, that this invention is not limited to the particular embodiment disclosed, but is intended to cover all modifications which are within the spirit and scope of the invention as defined by the appended claims.

We claim:

1. An adjustable frame for dispensing stackable items, the adjustable frame including:

a first panel having a first edge, a first-panel-dispensing-end, and a first major surface, the first major surface being configured to guide stacked items prior to dispensing from a location proximate to the first-panel-dispensing-end;

a second panel having a second edge, a second-panel-dispensing-end, and a second major surface, the second edge being located proximate to the first edge of the first panel, the second major surface being configured to, in combination with the first major surface, guide stacked items prior to dispensing from a location proximate to the second-panel-dispensing-end;

a base plate disposed proximate to the first-panel-dispensing-end and the second-panel-dispensing-end, the base plate being configured to support one end of a stack of items; and an adjustable panel having a third edge, and a third major surface, the third edge being detachably securable in one of a plurality of locations on the second major surface of the second panel, the third major surface generally opposing the first major surface of the first panel and being configured to prevent items from falling generally away from the first panel prior to being dispensed, wherein the adjustable panel can be positioned proximate to any one of the plurality of locations to accommodate items of various sizes;

wherein the first panel includes a sub panel having a sub-panel-major-surface, the sub panel being rotatable between a first position, in which the sub-panel-major-surface forms a portion of the first major surface, and a second position, in which the sub-panel-major-surface opposes the second major surface of the second panel, wherein when the sub panel is in the second position, the sub panel is adapted to prevent stacked items from falling away from the second panel prior to being dispensed.

2. The adjustable frame of claim 1, wherein the second panel includes a groove pattern disposed in the second major surface to allow the adjustable panel to be slidingly moved from one of the plurality of locations to another of the plurality of locations.

3. The adjustable frame of claim 2, wherein the groove pattern includes a plurality of downwardly extending channels allowing the adjustable panel to be slid into one of the plurality of locations to create a gravity bias against the adjustable panel being moved from the one of the plurality of locations.

4. The adjustable frame of claim 3, further including an illustration of the groove pattern, the illustration including a different one of a plurality of distinct markings labeling an illustration of each of the plurality of downwardly extending channels, the plurality of distinct markings each representing a corresponding one of a plurality of differently sized stackable items, wherein when the adjustable panel is fully engaged with one of the plurality of downwardly extending channels, the adjustable panel is properly positioned for the adjustable frame to hold a stack of the one of the plurality of differently sized stackable items represented by the corresponding one of the plurality of distinct markings.

5. The adjustable frame of claim 3, further including a different one of a plurality of distinct markings being disposed on the second major surface proximate to each of the plurality of downwardly extending channels, the plurality of distinct markings each representing a corresponding one of a plurality of differently sized stackable items, wherein when the adjustable panel is fully engaged with one of the plurality of downwardly extending channels, the adjustable panel is properly positioned for the adjustable frame to hold stacked items having a size corresponding to the one of the plurality of differently sized stackable items represented by the one of the plurality of distinct markings disposed proximate to the one of the plurality of downwardly extending channels securing the adjustable panel.

6. The adjustable frame of claim 2, wherein the adjustable panel further includes:

a flange disposed proximate to and oriented at an angle relative to the third major surface and having a major flange surface that forms the third edge of the adjustable panel, the major flange surface being in sliding contact with the second major surface of the second panel; and a peg extending from the major flange surface to engage the groove pattern in the second major surface of the second panel.

7. The adjustable frame of claim 1, wherein the second panel includes a cutout.

8. The adjustable frame of claim 7, further including a support plate slidingly disposed on a side of the second panel, opposite the second major surface, and coupled to the adjustable panel.

9. The adjustable frame of claim 8, further including a connector attached on one end to the support plate and attached on another end to the adjustable panel, the connector extending through the cutout in the second panel.

10. The adjustable frame of claim 9, wherein the connector is capable of urging the adjustable panel toward the support plate to secure the adjustable panel against the second panel.

11. The adjustable frame of claim 1, further including a second adjustable panel having a fourth edge, and a fourth major surface, the fourth edge being detachably securable in one of a second plurality of locations on the first major surface of the first panel, the fourth major surface generally opposing the second major surface of the second panel and being configured to prevent items from falling generally away from the second panel prior to being dispensed, wherein the second adjustable panel can be positioned proximate to any one of the second plurality of locations to accommodate items of various sizes.

12. The adjustable frame of claim 1, further including a different one of a plurality of distinct markings being disposed on the second major surface proximate to each of the plurality of locations, the plurality of distinct markings each corresponding to one of a plurality of differently sized stackable items, wherein when the adjustable panel is positioned in the one of a plurality of locations identified by one of a plurality of distinct markings, the one of the plurality of distinct markings indicates the type of items that the adjustable frame is configured to support.

13. An article dispensing system including:

a conveyor surface that receives a dispensed item;

an adjustable dispenser disposed above the surface, the adjustable dispenser including:

a first panel having a first edge, a first-panel-dispensing-end, and a first major surface, the first major surface being configured to guide stacked items prior to dispensing from a location proximate to the first-panel-dispensing-end;

a second panel having a second edge, a second-panel-dispensing-end, and a second major surface, the second edge being located proximate to the first edge of the first panel, the second major surface being configured to, in combination with the first major surface, guide stacked items prior to dispensing from a location proximate to the second-panel-dispensing-end;

a base plate disposed proximate to the first-panel-dispensing-end and the second-panel-dispensing-end, the base plate being configured to support one end of a stack of items; and an adjustable panel having a third edge, and a third major surface, the third edge being detachably securable in one of a plurality of locations on the second major surface of the second panel, the third major surface generally opposing the first major surface of the first panel and being configured to prevent items from falling generally away from the first panel prior to being dispensed, wherein the adjustable panel can be positioned proximate to any one of the plurality of locations to accommodate items of various sizes;

the dispenser being disposed above the surface in a tilted configuration such that the first panel defines a plane generally perpendicular to the surface and the second panel defines another plane forming less than a ninety (90) degree angle with the surface, wherein items are prevented from falling from the dispenser prior to dispensing by a combination of the incline of the second panel and by the adjustable panel; and wherein the first panel includes a sub panel having a sub-panel-major-surface, the sub panel being rotatable between a first position, in which the sub-panel-major-surface forms a portion of the first major surface, and a second position, in which the sub-panel-major-surface opposes the second major surface of the second panel, wherein when the sub panel is in the second position, the sub panel is adapted to prevent stacked items from falling away from the second panel prior to being dispensed.

14. The system of claim 13, wherein the adjustable frame further includes a second adjustable panel having a fourth edge, and a fourth major surface, the fourth edge being detachably securable in one of a second plurality of locations on the first major surface of the first panel, the fourth major surface generally opposing the second major surface of the second panel and being configured to prevent items from falling generally away from the second panel prior to being dispensed, wherein the second adjustable panel can be positioned proximate to any one of the second plurality of locations to accommodate items of various sizes.

15. The system of claim 13, further including a conveyor having a portion that forms the surface for receiving items.

16. The system of claim 13, wherein the second panel includes a groove pattern disposed in the second major surface to allow the adjustable panel to be slidingly moved from one of the plurality of locations to another of the plurality of locations, the groove pattern having a plurality of downwardly extending channels allowing the adjustable panel to be slid into one of the plurality of locations creating a gravity bias against the adjustable panel being moved from the one of the plurality of locations.

17. The adjustable frame of claim 16, further including an illustration of the groove pattern disposed thereon and including a plurality of distinct markings, a different one of the plurality of distinct markings labeling an illustration of each of the plurality of downwardly extending channels, the plurality of distinct markings each representing a corresponding one of a plurality of differently sized stackable items, wherein when the adjustable panel is fully engaged with one of the plurality of downwardly extending channels, the dispenser is properly configured to hold a stack of the one of the plurality of differently sized stackable items represented by the corresponding one of the plurality of distinct markings.

18. The system of claim 16, further includes a different one of a plurality of distinct markings being disposed on the second major surface proximate to each of the plurality of downwardly extending channels, the plurality of distinct markings each representing a corresponding one of a plurality of differently sized stackable items, wherein when the adjustable panel is fully engaged with one of the plurality of downwardly extending channels, the adjustable panel is properly positioned for the dispenser to hold stacked items having a size corresponding to the one of the plurality of differently sized stackable items represented by the one of the plurality of distinct markings disposed proximate to the one of the plurality of downwardly extending channels securing the adjustable panel.

19. The system of claim 13, further includes an optical detector capable of determining when the dispenser is empty.

20. The system of claim 13, further includes a different one of a plurality of distinct markings being disposed on the second major surface proximate to each of the plurality of locations, the plurality of distinct markings each corresponding to one of a plurality of differently sized stackable items, wherein when the adjustable panel is positioned in the one of a plurality of locations identified by one of the plurality of distinct markings, the one of the plurality of distinct markings indicates the type of items that the adjustable frame is configured to support.

21. An apparatus for dispensing stackable articles onto a surface, the apparatus including:

first and second generally planar panels, which include first and second major surfaces respectively, that form two sides of an article receptacle to define a bottom plane that is at an acute angle to the surface, wherein at least one of the first and second panels has a first groove pattern defined therein; and a third panel that defines a third side for the article receptacle and is slidably engaged with the first groove pattern for movement among a plurality of locations within the groove pattern to hold articles of various sizes in the receptacle;

wherein at least one of the first and second panels is angled from a perpendicular relative to the surface; and wherein the first panel includes a sub panel having a sub-panel-major-surface, the sub panel being rotatable between a first position, in which the sub-panel-major-surface forms a portion of the first major surface, and a second position, in which the sub-panel-major-surface opposes the second major surface, wherein when the sub panel is in the second position, the sub panel is adapted to prevent stacked items from falling away from the second panel prior to being dispensed.

22. The apparatus of claim 21, wherein a base plate is positioned adjacent to the bottom plane to retain an article in the article receptacle.

23. The apparatus of claim 21, wherein the at least one of the first and second panels includes the first and second panels.

24. The apparatus of claim 23, wherein the first and second panels are at a right angle with respect to each other.

25. The apparatus of claim 24, further including a second groove pattern in another one of the first and second panels to slidably engage a fourth panel to define a fourth side of the article receptacle.

26. The apparatus of claim 25, wherein the second groove pattern includes a plurality of downwardly extending channels adapted to gravity bias the fourth panel from dislocation.

27. The apparatus of claim 25, further includes at least one illustration of at least one of the first and second groove patterns, the illustration disposed on at least one of the first and second panels and including a different one of a plurality of distinct markings labeling an illustration of each of the plurality of downwardly extending channels, the plurality of distinct markings each representing a corresponding one of a plurality of differently sized stackable items, wherein when the adjustable panel is fully engaged with one of the plurality of downwardly extending channels, the adjustable panel is properly positioned for the article receptacle to hold a stack of articles of a type represented by the corresponding one of the plurality of distinct markings.

28. The apparatus of claim 23, wherein the groove pattern includes a plurality of downwardly extending channels adapted to gravity bias the third panel from dislocation.

* * * * *